United States Patent [19]

Gregory

[11] Patent Number: 5,052,190

[45] Date of Patent: Oct. 1, 1991

[54] APPARATUS FOR THE SENSING OF REFRIGERANT TEMPERATURES AND THE CONTROL OF REFRIGERANT LOADING

[75] Inventor: Charles Gregory, Burlington, Canada

[73] Assignee: Super S.E.E.R. Systems Inc., Burlington, Canada

[21] Appl. No.: 444,913

[22] Filed: Dec. 4, 1989

Related U.S. Application Data

[63] Continuation-in-part of Ser. No. 404,380, Sep. 8, 1989, which is a continuation-in-part of Ser. No. 229,038, Aug. 4, 1988, abandoned.

[51] Int. Cl.[5] ..... F25B 41/04; G01K 13/02

[52] U.S. Cl. ..... 62/225; 165/164; 165/185; 165/908; 236/DIG. 6; 374/138

[58] Field of Search ..... 62/225, 224, 524, 525, 62/527; 374/147, 148, 138, 135; 165/908, 133, 164, 185; 236/DIG. 6

[56] References Cited

U.S. PATENT DOCUMENTS

| | | | |
|---|---|---|---|
| 3,555,845 | 1/1971 | Huelle | 62/225 |
| 3,908,628 | 9/1975 | Lazaridis et al. | 165/154 X |
| 4,023,557 | 5/1977 | Thorne et al. | 165/133 X |
| 4,229,949 | 10/1980 | Brandin | 62/527 X |
| 4,671,675 | 6/1987 | Arisi et al. | 374/147 |
| 4,694,894 | 9/1987 | Kito et al. | 165/908 X |

*Primary Examiner*—Harry B. Tanner

*Attorney, Agent, or Firm*—Rogers & Scott

[57] ABSTRACT

A new device is provided for sensing refrigerant tempertatures in refrigerator systems, and for the control of refrigerant loading in a plurality of refrigerator evaporator circuit coils connected in parallel. Such evaporator coils are supplied with refrigerant through a termostatically controlled flow control valve, which is controlled by a sensor to ensure a predetermined amount of superheat. The usual minimum superheat is aobut 5.5° C. (10° F.) and to reduce this value the refrigerant is passed through the devide in which it is rendered thoroughly turbulent and mixed, the device intercepting the entire refrigerant flow just before the sensing of the superheat, thus ensuring that the temperature is accurately measured. In one aspect of the invention the device consists of a series of three chambers connected together by two similar sets of holes, the first and third chambers being similar so that it is completely reversible. In another aspect of the invention the part of the device wall intended to receive the sensor is provided with a groove into which the sensor fits snugly to increase the heat exchange contact between them. Grooves of different sizes can be provided in the same device. The heat conductive contact can be increased further by sandwiching a layer of pasty heat conductive material between the sensor and the groove wall that fills the space between them.

18 Claims, 3 Drawing Sheets

APPARATUS FOR THE SENSING OF REFRIGERANT TEMPERATURES AND THE CONTROL OF REFRIGERANT LOADING

CROSS-REFERENCE TO RELATED APPLICATIONS

This application is a continuation-in-part of my prior application No. 07/404,380, filed 8th Sept. 1989, which is a continuation-in-part of my prior application No. 07/229,038, filed 4th Aug. 1988, abandoned.

FIELD OF THE INVENTION

This invention is concerned with apparatus for the sensing of refrigerant temperatures in refrigerator systems and particularly with apparatus for the control of refrigerant loading in refrigerator evaporators.

REVIEW OF THE PRIOR ART

The standard refrigeration compressor-operated system consists of a closed circuit in which cool low-pressure refrigerant vapor from a suction line enters a compressor which compresses it to a hot high pressure vapor, this hot vapor then flowing through a discharge line to a condenser coil or coils where it is cooled below its condensing temperature and becomes liquid. The liquid flows from the condenser through a return line into a liquid receiver, and from the receiver through a liquid line to an indicator and filter/drier, from whence it passes to a thermostatically controlled expansion valve which maintains at an optimum value the flow of the liquid refrigerant into an evaporator coil or coils, in which it evaporates with consequent temperature drop and cooling of the coils and their environment; the resultant vapor passes through the suction line back to the compressor to complete the circuit.

It is essential to control the expansion valve (usually called the TX valve) so as to prevent any liquid refrigerant from reaching the compressor, which would damage it, and this valve control usually consists of a remote temperature sensing fluid-containing cylindrical bulb connected by a metal capillary tube to a charged diaphragm capsule in the valve. The capsule responds to changes in temperature of the sensor bulb to regulate the flow through the valve. Equivalent electrical sensors have also been developed. The sensor bulb or its equivalent normally is clamped tightly to the suction line at the exit from an outlet manifold into which the evaporator coil or group of coils discharge, so as to sense the temperature of the vapor at this point. The temperature characteristic of a vaporizing body of liquid is very standard in that its temperature will remain relatively constant at about the respective vaporizing (saturation) temperature as long as there is some liquid present to vaporize, and then will rise relatively rapidly when all the liquid is gone. To ensure that no liquid escapes from the evaporator the sensor is set for an operating temperature sufficiently higher than the saturation temperature, and the difference between these two temperatures is known as the superheat. As an example, a quite usual range of values for the saturation temperature of such a system is about −7° C. to about 4.5° C. (20° F. to 40° F.), while a quite usual value for the superheat is about 5.5° C. (10° F.), so that the range of control temperatures for such systems will be −1° C. to 10° C. (30° F. to 50° F.).

In theory it should be possible to use a much lower superheat value, say 1° C. (2° F.), but in prior art practice it was found that this was not sufficient to ensure the complete absence of liquid refrigerant from the evaporator manifold outlet and the higher value was therefore almost universally used. As the superheat value varies around the predetermined amount the TX valve opens and closes, and in theory should be operable to maintain it quite accurately at that value, but in practice there is a time lag between the sensing of the temperature by the sensor and the operation of the TX valve, which also usually cannot respond fast enough, resulting in a fluctuating superheat value necessitating the higher amount, thereby reducing the efficiency of the system. There has therefore been a continuing need for a temperature sensor for such systems which can more accurately determine the temperature of the refrigerant vapor in the suction line and thus improve the efficiency.

In commercial refrigerators, most evaporators consist of a large number, often as many as fifty, separate "circuit coils" connected in parallel so as to obtain sufficient cooling capacity without the individual coils being of too great length with consequent high pressure drop. These circuit coils are arranged in sets, each set having its own expansion valve and a common distributor interposed between the valve and the coils of the set, the purpose of the distributor being to divide the flow as equally as possible between individual small diameter feed pipes of equal length leading from the distributor to the respective circuit coil pipe inlets. All of the circuit coil pipe outlets are connected to a common outlet manifold or stand-pipe. Despite the care that is taken to try to make the valve and the distributor feed equal amounts of liquid refrigerant to the circuit coils, and to make all of the circuit coils as equal in length and flow characteristic as possible, it is in practice always found that liquid refrigerant vaporizes in some of the coils at a different rate than in the others, due to variables such as differences in the flow of air over the different coils, and small differences in the pressure drop through each coil. The consequence is that the circuit coil or coils which absorb the least amount of ambient heat allow the liquid refrigerant to flow further along it or them before vaporizing, so that it is this coil or coils that control the TX valve and close it down, starving the remainder of the coils of liquid refrigerant and excessively superheating the refrigerant vapor in the starved coils, and thereby reducing the cooling capacity of the system. This reduction can be as much as from about 25 to 35% of the total capacity.

This unequal loading of the evaporator circuit coils can usually be observed by visual inspection of the coils once the system has been in operation of a short time, when the starved circuit coils are less frost coated toward the outlet end than the others. This unequal loading is often mistakenly attributed to unequal distribution of the refrigerant liquid among the coils.

There is disclosed and claimed my prior application No. 07/404,380, filed 8 Sept. 1989, the disclosure of which is incorporated herein by this reference, apparatus for the sensing of the temperature of refrigerant exiting from a refrigeration system evaporator coil outlet and for the control in accordance with the sensed temperature of a controllable evaporator valve feeding liquid refrigerant to the evaporator coil inlet the apparatus comprising:

a turbulating and mixing device having an inlet and an outlet for refrigerant and having therein a refrigerant flow path having at least part of a wall thereof of heat conductive material for sensing the device interior temperature through the wall part;

turbulence and mixing producing means in the flow path intercepting the entire refrigerant flow and creating turbulence and mixing of the refrigerant with changes in the direction of the entire refrigerant flow to ensure turbulence and mixing of all liquid and vapor refrigerant phases present and contact of only mixed phases with the wall part; and the apparatus being adapted to have in heat conductive contact with the wall part temperature sensing means for sensing the device interior temperature and for controlling the evaporator valve in accordance with the sensed temperature.

There is also disclosed and claimed in that prior application apparatus for use in a refrigeration system comprising:

a refrigerant compressor;

a condenser coil receiving refrigerant from the compressor to cool it;

a common, thermostatically controlled refrigerant flow control valve receiving the cooled refrigerant from the condenser coil;

an evaporator coil comprising a plurality of circuit coils connected in parallel with one another so that all are supplied with refrigerant from the common control valve;

a common member having an inlet and an outlet receiving the refrigerant exiting from all of the circuit coils; and conduit means connecting the compressor, condenser coil, common control valve, evaporator coil, common member inlet, common member outlet and the compressor in a closed loop in the order stated;

a superheat temperature sensor detecting the temperature of the refrigerant at the common member outlet and operatively connected to the control valve for control thereof;

the apparatus comprising the said turbulating and mixing device in the said loop at the common member outlet and turbulating and mixing the refrigerant flows from the circuit coils to average the temperatures of the flows, the temperature sensing means sensing the device interior temperature.

DEFINITION OF THE INVENTION

It is therefore a principal object of the present invention to provide a new apparatus for the sensing of refrigerant temperatures in refrigerator systems, and in particular a new apparatus by which the temperature of the refrigerant exiting from an evaporator coil is sensed more efficiently by the temperature sensor controlling the TX valve for more precise superheat control.

In accordance with the present invention there is provided apparatus for the sensing of the temperature of refrigerant exiting from a refrigeration system evaporator coil outlet and for the control in accordance with the temperature sensed by a sensing means of a controllable evaporator valve feeding liquid refrigerant to the evaporator coil inlet, the apparatus comprising a turbulating and mixing device having an inlet and an outlet for refrigerant and having therein a refrigerant flow path having at least part of a wall thereof of heat conductive material for sensing the enclosure device interior temperature through the wall part;

the said wall part having a grooved portion in which the sensing means can be disposed in heat exchange contact with the wall part, corresponding in cross-section to the cross-section of the sensing means to increase the heat conductive contact of the sensing means with grooved portion;

and turbulence and mixing producing means in the flow path intercepting the entire refrigerant flow and creating turbulence and mixing of the refrigerant with changes in the direction of the entire refrigerant flow to ensure turbulence and mixing of all liquid and vapor refrigerant phases present and contact of only mixed phases with at least the grooved portion of the wall part.

Also in accordance with the invention there is provided apparatus for the sensing of the temperature of refrigerant exiting from a refrigeration system evaporator coil outlet and for the control in accordance with the temperature sensed by a sensing means of a controllable evaporator valve feeding liquid refrigerant to the evaporator coil inlet, the apparatus comprising:

a turbulating and mixing device having an inlet and an outlet for refrigerant and having therein a refrigerant flow path having at least part of a wall thereof of heat conductive material for sensing the enclosure device interior temperature through the wall part;

the device comprising a first tubular member having at least approximately midway along its interior a transverse barrier dividing the interior into a first chamber connected to the inlet and a second chamber connected to the outlet and against which the refrigerant flow impinges to produce resultant turbulence in the first chamber;

a second tubular member surrounding the first tubular member to form an annular second chamber between them;

a first set of bores provided in the wall of the first passage and directing the refrigerant flow into the second chamber against the inner wall of the second tubular member, and;

a second set of bores provided in the wall of the third chamber directing the refrigerant flow from the second chamber into the third chamber.

DESCRIPTION OF THE DRAWINGS

Embodiments of the invention will now be described, by way of example, with reference to the accompanying schematic and diagrammatic drawings, wherein.

The same or similar parts are given the same reference in all the figures of the drawing, wherever that is possible.

DESCRIPTION OF THE PREFERRED EMBODIMENTS

Figure 1:
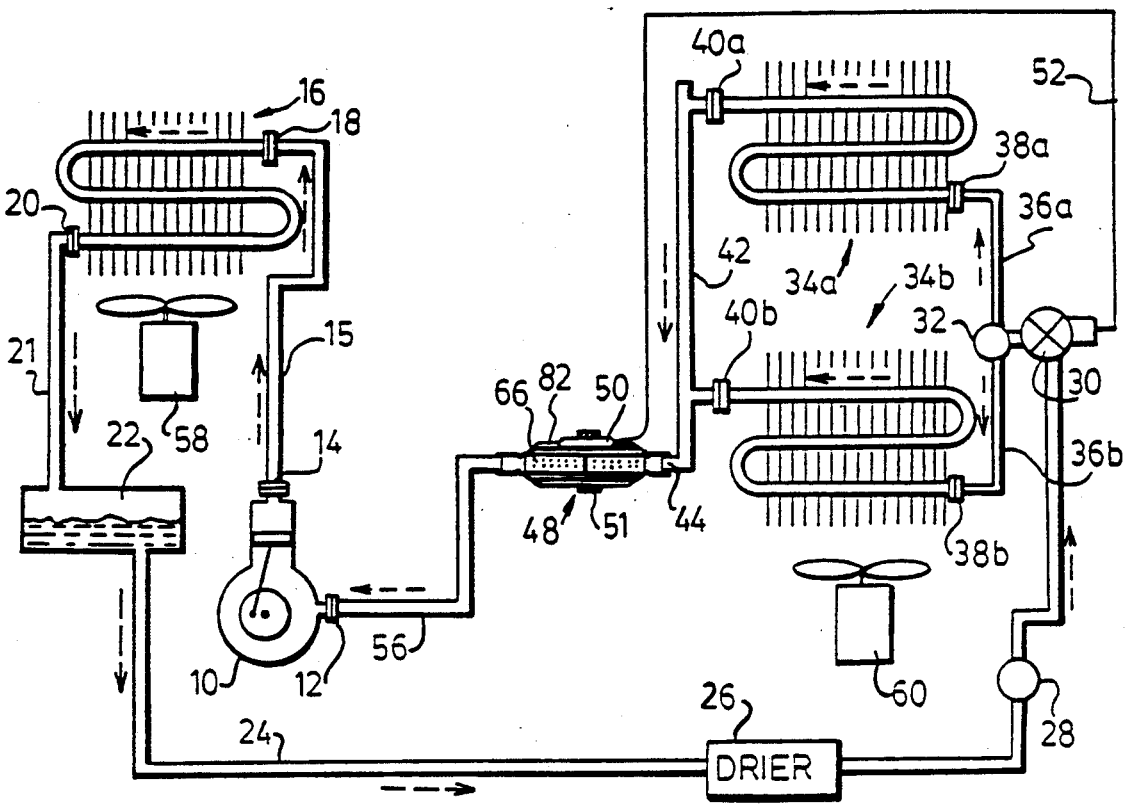
FIG. 1 is a schematic diagram illustrating a typical refrigeration system and including a device that is a first embodiment of the invention.

Referring now to FIG. 1, a typical refrigeration system to which the apparatus of the invention can be applied comprises a refrigerant compressor 10 having a suction inlet 12 and a high pressure outlet 14, the compressor feeding the hot compressed refrigerant fluid via conduit 15 to a condenser coil 16 having an inlet 18 and an outlet 20. Cooled refrigerant from the coil 16 passes via conduit 21 to a liquid accumulator 22, and thence via conduit 24 through a filter/drier 26, a liquid indicator 28 and a common thermostatically controlled refrigerant flow control TX valve 30 into a distributor 32, from which it flows into two parallel-connected circuit coils 34*a* and 34*b* of an evaporator coil. For convenience in illustration only two circuit coils are shown, but in practice there can be as many as fifty in a single large evaporator coil, each circuit coil being connected by a respective inlet pipe 36*a* and 36*b* to the common distributor 32. As described above in practice care is taken to make all of the circuit coils 34*a*, 34*b*, etc., and all of the pipes 36*1*, 36*b*, etc., of the same length and as equal as possible, so that the refrigerant will be distributed as equally as possible among them.

Each circuit coil has an inlet 38*a*, 38*b* respectively and an outlet 40*a* and 40*b* respectively, the latter all being connected to a common header pipe 42 (sometimes also called a stand-pipe or manifold), the single outlet 44 of which is connected to inlet 46 of a turbulator and mixing device 48 of the invention. A superheat temperature sensing bulb 50 by which the TX valve 30 is controlled is tightly clamped to the exterior of the device 48 by a clamp 51 to be in good heat exchange with its interior through the device wall and is connected by a capillary tube 52 to the valve 30. The outlet 54 of the device 48 is connected by conduit 56 to the pump inlet 12 to complete the system circuit. The usual fans 58 and 60 are provided to circulate ambient air over the coils 16 and 34*a*, 34*b* respectively. The numerous other circuit elements, controls and indicating devices that such a system normally includes do not constitute part of this invention and therefore do not need to be illustrated. The direction of flow of the refrigerant is indicated by the broken arrows.

Figure 2:
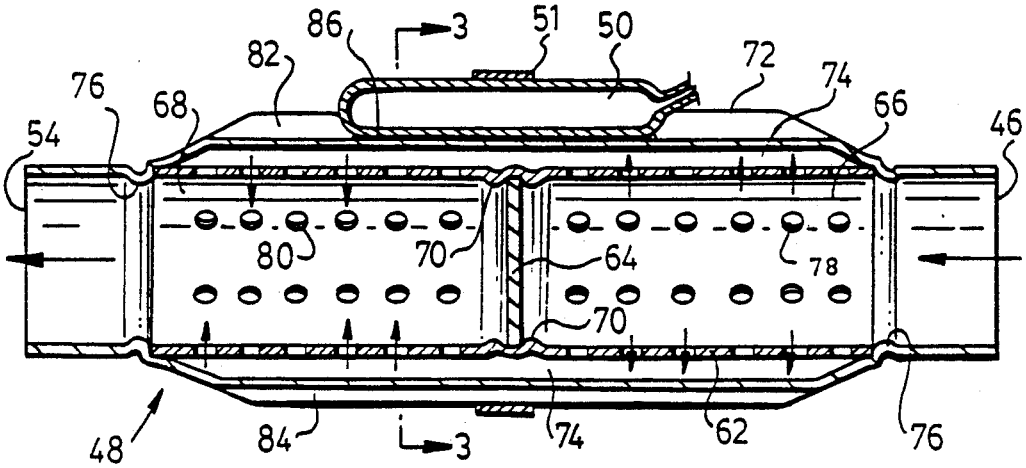
FIG. 2 is a longitudinal cross-section to a larger scale of the device of FIG. 1.

Referring now also to FIG. 2, this particular device 48 is made of metal, preferably a high conductivity metal such as copper or brass, and consists of a first inner cylindrical pipe 62, provided at least approximately at its middle along its length with a transversely-extending circular disc 64 comprising an end barrier extending over its entire cross-sectional area and dividing the interior of the pipe into two separate independent cylindrical chambers 66 and 68, called for convenience in terminology the first and third chambers. In this embodiment the disc is retained in position by its entrapment between two radially inwardly extending circular ridges 70 produced by a die-forming operation in the pipe; it may be noted that the joint between the disc and the inner wall of the pipe does not need to be absolutely gas tight. A second outer cylindrical pipe 72 having a central portion of larger diameter than its two end portions surrounds the first inner pipe 62 coaxial therewith and is sealed to the pipe at both ends, thereby forming an annular cross-section second chamber 74 between the two pipes. The inner pipe is held securely within the outer pipe between two radially inwardly extending circular ridges 76 die-formed in the outer pipe, and the ends of the outer pipe are reduced in diameter to the size required for the system in which it is inserted, one end constituting the inlet 46 while the other end constitutes the outlet 54.

The fast flowing refrigerant fluid entering the pipe 62 impinges strongly against the transverse barrier 64 and immediately becomes extremely turbulent within the first chamber 66. The inner pipe has a first set of a plurality of holes 78 distributed uniformly along the part of its length within the first chamber 66, and also distributed uniformly around its periphery, which holes direct the turbulent refrigerant vapor in the chamber 66, together with any liquid entrained therein, forcibly into the chamber 74 against the inner wall of the outer pipe 72. The inner pipe has another set of a plurality of holes 80 similarly uniformly distributed along the part of its length within the second chamber 68 and around its periphery, which holes direct the highly turbulent vapor in the chamber 74 back into the third chamber 68 and out of the outlet 54, the abrupt change of direction of the vapor required for its passage through the second set of holes 80 considerably increasing its turbulence in the chamber 74. The pipes 62 and 72, the barrier 64, and the bores 78 and 80 therefore provide within the interior of the device a direction-changing flow path between the inlet and the outlet that produces a thorough turbulating and mixing action on the refrigerant. The combination of the tortuous path formed by the successive chambers 66, 74, and 68, the abrupt changes in direction of the fast-flowing fluid, the turbulence in the inner pipe chamber 66 because of the impingement of the fluid against the closed end, and the turbulence in the annular chamber 74 between the two pipes because of the said impingement against the outer pipe inner wall, and its subsequent change of direction to exit through the holes 80, all ensuring that the entire refrigerant flow in the flow path, whether in the liquid or vapor phase, is all thoroughly mixed and rendered turbulent, and particularly without any possibility of the relatively high velocity vapor phase being able to flow through the device separately from the liquid phase. Moreover, the vigorous impingement of the high velocity fluid against the outer pipe inner wall ensures that any relatively stagnant barrier layer of refrigerant, or of the lubricating oil that is always entrained therein, is thoroughly disrupted and removed from the inner wall, so that it cannot prevent the efficient transfer of heat from the refrigerant through the wall to the sensor bulb 50. The bulb is therefore sensing only the temperature of a completely turbulent mixed and temperature averaged refrigerant flow as received from the outlet of the header pipe 42, and in addition is much more sensitive to changes in the refrigerant temperature and more accurately measures the device interior temperature which corresponds to the averaged refrigerant temperature. This turbulating and mixing function of the device 48 is effective in this manner whatever the evaporator coil structure employed in the system.

Unexpectedly I have found that a device as specifically described, employing three successive chambers with two abrupt changes of direction through respective sets of holes, is more efficient in providing for accurate measurement of the temperature of the fluid refrigerant than my prior embodiment, as described and illustrated in FIG. 2 of my above identified prior application, which employs two successive chambers with only a single abrupt change of direction through a single set of holes. Another substantial commercial advantage of this embodiment is that it is symmetrical end for end and completely reversible, so that it is immaterial which end is employed as the inlet and which is employed as the outlet; the installer is therefore able to install it in the line 56 without having to consider the direction of refrigerant flow through the device. It was found with the prior art devices that there was a small but noticeable decrease in performance if it had been installed reversed, but this cannot happen with the devices of the present invention.

Another improvement in performance is obtained in apparatus in accordance with this invention by providing the outer pipe 72 with a longitudinal exterior groove 82 of cross-section corresponding to that of the sensor bulb 50, so that there is maximum practical heat-exchange surface contact between the bulb and the pipe 72, and thus between the interior of the chamber 74 and the bulb. In practice sensor bulbs as used in refrigeration systems are almost universally of cylindrical shape and circular cross-section, and accordingly the groove 82 is made of semi-circular cross-section of size such that the bulb will fit snugly within the groove and be held firmly in place by the band clamp 51. It is also found in commercial practice that sensors are usually either of diameter 12.8 mm (0.5 in) or 9.5 mm (0.375 in), and accordingly the tube 72 is provided with two circumferentically spaced grooves 82 and 84 of these two different diameters, so that the installer can chose the one appropriate for the size of bulb to be used. More than two spaced grooves can be provided if more than two sizes are involved. The formation of the groove or grooves, usually by a die-forming operation, will result in a small decrease in the cross-section area of the annular passage 74, and this can readily be compensated, if required, by a small increase in diameter of the central portion of the pipe 72. Neither the pipe 72 nor the bulb 50 are likely in practice to be manufactured to close tolerances, and to ensure even better heat exchange contact between them the wall of the selected groove may be pre-coated with a layer 86 of heat-conductive paste, which is squeezed between them as the bulb is pressed into the groove by the band clamp 51 and fills any air space that might otherwise be left between them.

In prior practice the circular cross-section bulb has usually been clamped to the exterior of the circular cross-section pipe with their axes parallel, and at best there is only a line contact between them where their peripheries touch one another. In practice the situation is often much worse in that, if the installer does not mount the bulb carefully it may be somewhat skewed relative to the pipe, with the axes no longer parallel, whereupon the area of contact is correspondingly reduced. This can very easily happen since it has been usual to attach the bulb by means of two longitudinally-spaced band clamps, and it is comparatively easy during the installation of the second clamp for the bulb to become skewed; and even a small amount of skew causes a considerable reduction in contact area. With a device of this aspect of the invention all that is required is for the installer to select which of the grooves is closest in size to the bulb while able to receive it, apply a bead or layer of the heat conductive paste material to the wall of the groove, place the bulb in position in the groove and clamp it firmly in place using only a single clamp, whereupon accurate positioning and alignment is immediately assured.

The grooves 82 and 84 can be made of cross-sections that are more than semi-circular to increase the contact area, but the bulbs must then be slid endwise into the groove, which may be difficult in some installations; such re-entrant grooves are more difficult to manufacture than the open-mouth semicircular grooves illustrated.

The devices of the invention have the advantages both to the installer, and to the owners of the apparatus in which they are installed, that they not only produce an improvement in performance of the system by permitting a substantial reduction in the superheat, but they provide a pre-established preferred and easier installation location for the sensor bulb that both ensures the improved performance will be obtained and also simplifies the installation procedure. Thus, in practice once the decision has been made to install a device of the invention, which is easily done with new equipment, and which for retrofitting to old equipment involves the relatively simple procedure of cutting a section from the pipe to permit its insertion therein, the hitherto sometimes difficult questions of proper location and correct installation of the sensor bulb are also readily and positively determined.

The provision of a groove in the suction pipe of a system for reception of the sensor can with advantage be applied to the existing systems by providing a special grooved section of pipe that is installed at each coil outlet, or as close thereto as possible. As with the other embodiments, such a device may be provided with two or more circumferentially disposed grooves of different sizes to accommodate different sizes of sensor. Moreover, it is now practical and feasible to provide a layer of heat conductive pasty material in the groove between the pipe wall and the sensor. Such a grooved pipe increases the effectiveness of the sensor, as well as its ease of installation, and will permit a reduced amount of superheat, although not as much as by the other turbulating and mixing devices of the invention.

When the device is used with a system as specifically described, namely with multiple circuit coils, then in addition to turbulating and mixing the fluid flow in each evaporator circuit coil it also performs a multiple mixing function, whereby the fluid flows from all of the circuit coils are thoroughly mixed together, so that all of their separate temperatures are averaged, and it is this average circuit coil temperature that is detected by the bulb 50. Moreover, this very thorough turbulence and mixing ensures that if one or more of the circuit coils is not evaporating all of its supply of refrigerant, then the small quantities of liquid reaching the mixing device are immediately atomized and consequently easily vaporized by heat from the superheated vapor from the remaining coils. The supply of refrigerant to the starved coil or coils can therefore be increased until the superheated vapor they produce is not able to vaporize the liquid refrigerant from the underloaded coil or coils.

The diameters of the pipes 62 and 72 are such that the flow capacities of the resultant flow passages are about that of the remainder of the suction tube 56, while the number and size of the apertures 78 and 80 are such that about the same flow capacity is achieved. These flow capacities can vary between about 0.5 and 1.5 times the usual flow capacity of the suction tube; it may be preferred to reduce the flow capacity of the apertures 78 somewhat below that of the apertures 80 and that of the suction tube in order to obtain sufficiently forceful impingement of the fluid against the outer tube inner wall.

In one specific embodiment intended for use in a system of about 2–3 h.p. the outer pipe 72 is about 23 cm (9 ins.) long and 3.5 cm. (1.375 ins.) maximum outside diameter; the inner pipe 62 is about 17 cm (6.75 ins.) long and 2.2 cm (0.875 in.) inside diameter and is provided with the two sets of uniformly spaced holes, each of which is 3.1 mm (0.125 in.) in diameter. Each set consists of six circumferentically-spaced rows, each of seven holes, for a total of forty two holes for each set.

In another specific embodiment intended for use in a system of about 10–15 h.p. the outer pipe 72 is about 23 cm (9 ins.) long and 6.35 cm. (2.5 ins.) maximum outside diameter; the inner pipe 62 is about 17 cm (6.75 ins.) long and 4.4 cm (1.75 in.) inside diameter and is provided with the two sets of uniformly spaced holes, each of which is 6.3 mm (0.25 in.) in diameter. Each set consists of five circumferentically-spaced rows, each of six holes, for a total of thirty holes for each set.

In practice if the system is of power from about 40 h.p. and up it is usual to split the coils into two sets and to provide each with a separate TX valve controlled from its respective sensor. Except therefore for special installations it is unlikely that a device with an inner pipe 62 of more than 7.8 cm (3.125 ins) O.D. will be required. It is found in practice that the pressure drop through the devices of the invention is sufficiently low, usually less than about 1 p.s.i., that it does not produce any appreciable loss of efficiency, and any loss for this reason is amply compensated by the overall considerably improved efficiencies that usually are obtained The drop is sufficiently small that it is difficult, if not impossible, to detect with the pressure gauges that are used in standard refrigeration service practice Despite the lengthy period of time for which these problems have existed it does not appear to have been understood how to provide turbulator means and/or mixing means that will sufficiently improve the temperature detection and control of the TX valve, and also in multiple coil systems to average the temperatures of the refrigerant flows from the large number of individual circuit coils for the same purpose. Thus, the current commercial literature in the industry of which I am aware seems to assume that all that can be done is to make the lengths of the circuit coils as equal as possible, to discharge all of the circuit coils into a common header pipe, and to clamp the sensor bulb to the outside of the outlet pipe from the header pipe, when the temperature will be measured as accurately as possible and the flows will be mixed to the maximum obtainable extent.

I believe that this mistaken assumption may have resulted from a lack of adequate appreciation of the flow conditions of the refrigerant fluid in the evaporator coils and the outlet pipe or manifold. The refrigerant enters the coils as a low volume liquid and is evaporated in the confined spaces thereof to a high volume vapor, with the result that the exit speed of the vapor is relatively high, to the extent that in the absence of the highly positive turbulating and/or mixing apparatus of the invention, involving the entire fluid flow or flows, the flows in the coils remain laminar and any liquid particles remain entrained without mixing, while there is little or no opportunity for the flows from the different coils to mix and average. Consequently there is little opportunity for any small quantities of liquid refrigerant to be evaporated before the temperature must be sensed by the bulb 50. It is essential for the turbulating and mixing to be carried out across the entire cross-section of the flow path, since any gaps will allow the corresponding portion or portions of the high velocity fluid passing through them to remain laminar with liquid particles entrained and defeat the purpose of the device. The situation would not be made much better in the prior art apparatus by placing the sensor bulb 50 further along the suction pipe 56, since the flows will still remain relatively laminar along the pipe, and any additional distance of the bulb from the evaporator outlet and from the TX valve introduces additional difficulty because of the increased time delay for operation of the TX valve.

As evidence of this current lack of appreciation of the problem there is and has been considerable discussion of the best physical arrangement for the coils to ensure that they are equally loaded, and it has been considered important in prior refrigeration systems to locate the sensor bulb 50 appropriately on the circumference of the suction pipe in order to sense the superheat temperature as accurately as possible and operate with minimum superheat. The manufacturers of TX valves in their installation manuals stress the importance of proper location of the sensor bulb, but do not give a definitive location for it. They advise that preferably the bulb should be fastened to a horizontal portion of the suction line, and clamped at different places around its circumference depending on the diameter, but the location is finally chosen by the installer depending upon what appears to be suitable and/or practicable for that installation, often with poor results. The theoretically ideal location is at 6 o'clock on the circumference of a horizontal suction pipe, where it should be able to sense most accurately any small quantity of liquid refrigerant passing in the pipe, and would therefore permit the smallest amount of superheat. In practice this has not been a satisfactory location because of the presence of lubricant oil in the refrigerant, which flows along the bottom of the pipe and would thermally insulate the sensor bulb from the refrigerant fluid. The usual location for the bulb has therefore been at four or eight o'clock on the pipe circumference. It is found that with the thorough turbulence and mixing provided by the devices of the invention the location of the sensor bulb around the circumference of the device is no longer critical, and it can be placed at the most convenient location from the point of view of installation and subsequent access for service. It will also be seen that the sensor need not be located directly on the wall of the mixing device enclosure, which is however overwhelmingly the preferred location, especially with the ease and certainty of installation provided by the grooved wall, but should be located as close as possible to the device outlet. In addition it is now found unnecessary to locate the sensor bulb on a horizontal portion of the suction line, and the attitude of the device has no effect upon its performance.

The effectiveness of a device of the invention can readily be seen by visual inspection of the evaporator coil before and after its installation. Before installation it is usually found that the frost deposition on the different circuit coils is non-uniform with some of them completely frosted up to the outlet, while others are not frosted for a substantial distance back from the outlet, showing that the latter are starved of refrigerant and are working much below their maximum cooling capacity. Also the evaporator common outlet member is only partially frosted. With the device installed all of the circuit coils become more or less equally frosted, as well as the entire length of the suction manifold, indicating that all of the circuit coils are now operating at their full designed capacity. It is now found possible safely to reduce the amount of superheat from the prior value of about 5.5° C. (10° F.) to as low as 2° C. (4° F.). In some installations the resultant improvement in cooling capacity of the system can reach as much as 25–35%, indicating that the system previously was operating at only 74–80% of the available capacity.

As a specific example, in an installation employing compressors totaling 200 h.p. and eight forced air evaporator coils the system prior to the installation of the devices of the invention took 3 hours, 10 minutes to cool the room temperature from 13° C. (55° F.) to −19° C. (−2° F.). With the devices installed the time taken was reduced to 2 hours, 10 minutes, an improvement of 29% in efficiency or equivalent to increasing the output of the compressors to about 258 h.p.

An important advantage that has been found to follow from use of the invention, demonstrating its unexpected nature, is the flexibility that is obtained upon installation in not having to closely match the size of the TX valve to the evaporator coil capacity without the valve losing control of the refrigerant flow. The capacity of a TX valve is determined both by the size of its flow aperture and the head pressure across the aperture, and it has been important in prior art installations for this match to be as close as possible. For example, one manufacturer provides 21 different sizes of valve to cover the range 0.5–180 tons, those in the range 0.5–3 tons being rated in 0.5 ton increments, with progressively increasing intervals up to the maximum. If the valve is too large then with the high superheat values employed the valve hunts, overfeeding and underfeeding the evaporator with resultant poor efficiency and danger of liquid reaching the compressor because of the over-large flow capacity of the valve while open. On the other hand, with the valve and coil sizes closely matched it becomes necessary to maintain the head pressure above a minimum value, since otherwise the valve flow capacity becomes too low. This penalizes the system in winter when the air cooled condensers are very efficient and could operate with lower head pressure; instead it is necessary to maintain it artifically high by various techniques that are available. This means that the power required to compress the refrigerant must also be maintained at a corresponding high uneconomical value.

This loss of control is easily observed in practice. For example, if the evaporator fan stops for some reason, perhaps a broken fuse, or the flow of product being cooled is interrupted, the load on the coil drops suddenly, faster than can be controlled by the valve, and liquid floods the compressor, which then becomes covered with frost when it should be frost-free. The liquid refrigerant washes out the lubricant, and can cause valve breakage and damage. Again, if the automatic coil defrost system is not operating satisfactorily and the coils become coated with ice the load on each coil drops and control can be lost; this of course is easily detected by visual inspection of the coils.

Upon installation of a device or devices of the invention it is found that this close match of load capacities is no longer necessary and an oversize valve can be employed successfully. In a specific example, in a system with a 1.5 ton evaporator the original 2 ton rated valve was replaced with an 8 ton rated valve; adequate control was maintained with the superheat value fluctuating about 0.5°–1° C. (1°–2° F.). Thus with a larger orifice TX valve it is no longer necessary to keep the head pressure at an artificially high value to maintain adequate refrigerant flow through the valve, and instead it could be allowed to drop to a lower level and still maintain proper superheat control with maximum evaporator capacity. This not only maximizes the efficiency of the system but also provides the possibility of reducing the number of different sizes of valves required for a full range of installation sizes.

Figure 3:
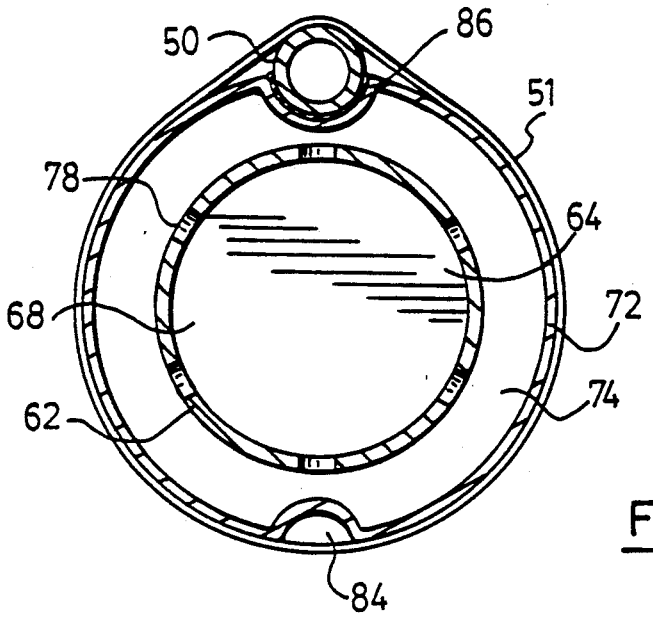
FIG. 3 is a transverse cross-section of the device of FIG. 2, taken on the line 3—3 in FIG. 2.
Figure 4:
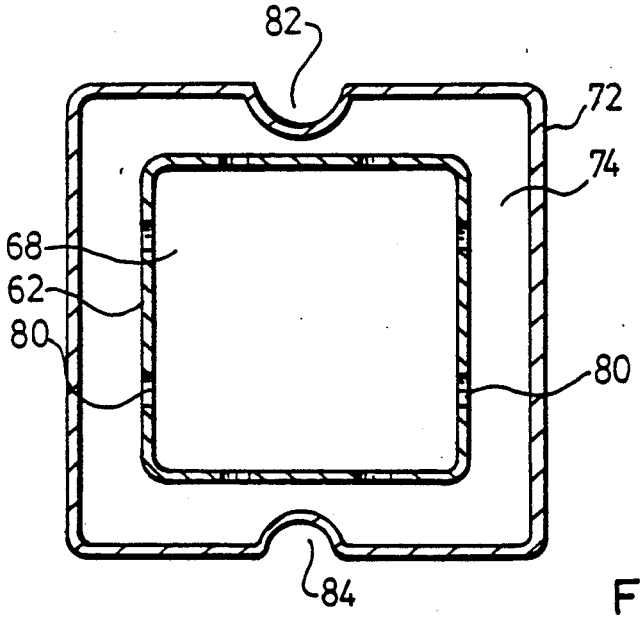
FIG. 4 is a transverse cross-section similar to FIG. 3 through another device of the invention.

In commercial refrigeration practice circular cross-section pipes are universally used, and pipes of such cross-section are illustrated for the device shown in FIGS. 1–3. However, the devices of the invention can also be made using pipes of other cross-sections, such as the square cross-section illustrated by FIG. 4.

Figure 5:
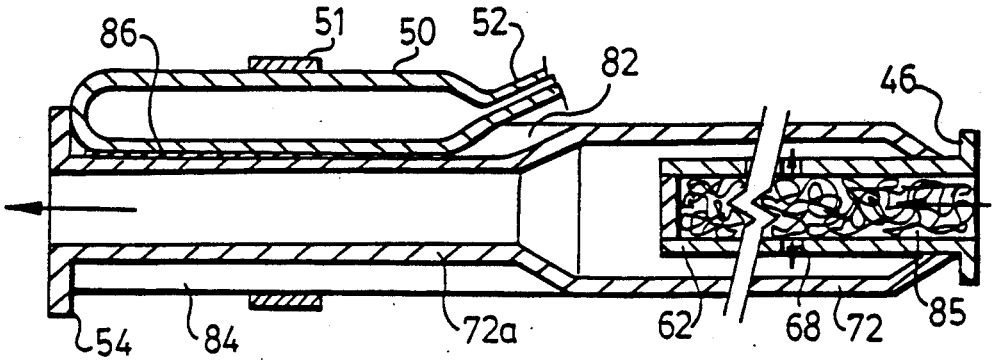
FIG. 5 is a side elevation through a device that is a further embodiment.

FIGS. 5 through 8 illustrate the invention applied to the other forms of device described and claimed in my above-identified prior application. As described above, if the sensor bulb 50 is not mounted directly on the wall that is impinged by the turbulent fluid, then it should be installed as close as possible to the device outlet 54 where the maximum mixing has occurred. In the embodiment of FIG. 5 the external tube 72 is provided with an integral elongated neck portion 72*a* constituting the outlet 54 on which the bulb is fastened. In this embodiment the interior of the inner pipe 62 is completely filled with metallic wool 85 as a mixing medium.

Figure 6:
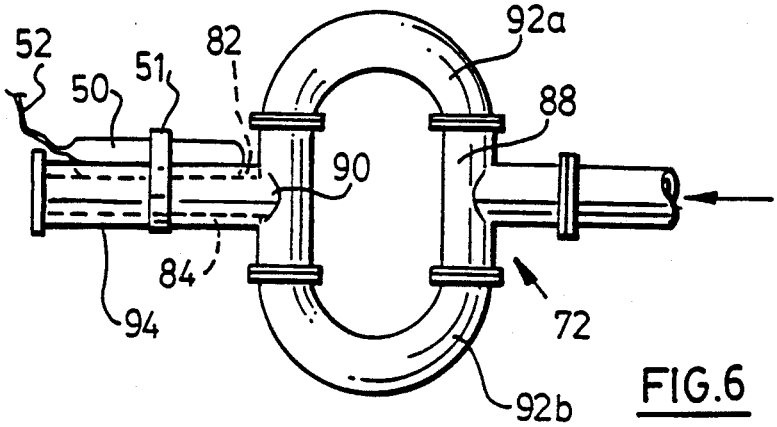
FIGS. 6 through 8 are respective longitudinal cross-sections through further embodiments.

FIG. 6 shows an embodiment in which the refrigerant flow path is provided by conduits forming two T-shaped junctions 88 and 90 connected by U-shaped connectors 92*a* and 92*b*; the connectors may be of smaller internal cross-section diameter to produce an increase in flow velocity of the refrigerant. The junction 88 divides the refrigerant flow from the common header 42 into two separate approximately equal sub-streams which are rendered turbulent by their impact against the transverse wall of the T cross-bar, the two streams moving separately at high velocity in the connectors 92*a* and 92*b* and being re-combined with a "head-on" collision in the cross-bar of the junction 90 back into a single stream. This collision of the two turbulent sub-streams produces even more turbulent mixing thereof, so that effective mixing and turbulence takes place before the refrigerant is delivered to the leg 94 of the second T-shaped junction, in the groove 82 or 84 of which the bulb 50 is installed. Although in this embodiment the refrigerant flow is divided into only two separate streams, in other embodiments it may be divided into more than two, all of which are simultaneously or sequentially recombined.

Figure 7:
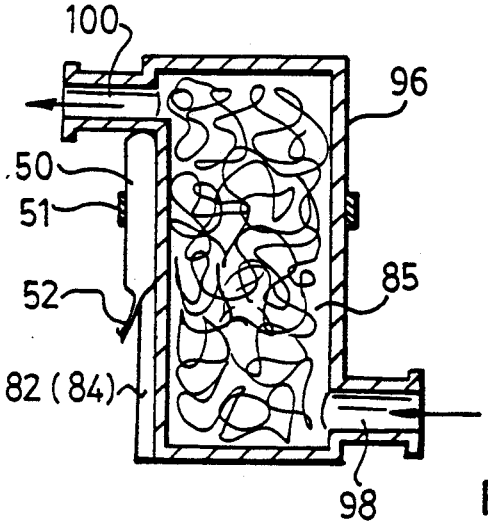

FIG. 7 shows a further embodiment wherein the device consists of a container 96 having an inlet 98 for unturbulated, unmixed refrigerant and an outlet 100 for turbulent mixed refrigerant, the inlet and outlet being spaced from another along the length of the container, and both being disposed radially with respect to the longitudinal axis of the container, so that abrupt changes in direction of the fluid flow path are produced. The interior of the container is filled with a porous turbulating and mixing medium 85 through which all of the refrigerant must pass in moving from the inlet to the outlet. The movement of the refrigerant fluid through the myriad of random interconnected channels in the medium 85 ensures the necessary thorough turbulence and/or mixing thereof. A suitable medium is for example metallic wools, foams or screens, or other suitable metallic media, particularly of stainless steel or aluminum, packed sufficiently densely to achieve the desired amount of turbulence and mixing without too great a pressure drop. Other media such as open-celled porous plastic and ceramic foams can also be used. Sensor bulb 50 is firmly clamped into the selected groove 82 or 84 in the heat conductive container inner wall, as close as possible to the outlet 100. In an example the container 96 was 10 cm (4 ins) in diameter and 25 cm (10 ins) long and was packed with stainless steel wool. Advantageously the body of wool is surrounded by at least a single layer of wire mesh to ensure that pieces of the wool cannot break off and enter the system.

Figure 8:
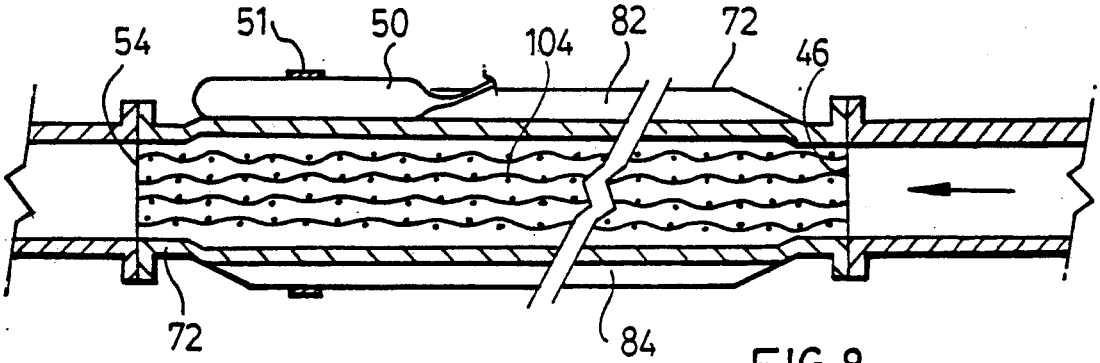

FIG. 8 shows an embodiment in which the device comprises a straight length of pipe 72 the whole interior of which is filled with closely wound wire mesh 104, so that again the entire refrigerant flow is intercepted, rendered sufficiently turbulent and mixed to the necessary extent. Because in this embodiment the abrupt changes of direction in the flow path take place within the interstices of the wire mesh, the device preferably is made much longer so as to provide a longer path than with the previously described turbulating and mixing devices, the sensor bulb 50 being installed, as with the other embodiments, in the selected groove 82 or 84 as close as possible to the outlet end 54. As an example of the additional length required a device fitted in a system with a compressor of 10 h.p. capacity employed a pipe 72 of 4.0 cm (1.6 in) outside diameter, enclosing a tightly spirally rolled stainless steel mesh; the pipe was 45 cm (18 in) long, as compared with the length of 20–25 cm (8–10 in) required for the device of FIG. 2. However, it may also be noted that in another specific example a device was produced employing a straight enclosure between the inlet and the outlet consisting of a piece of pipe 25 cm (10 in) long and 4 cm (1.6 in) outside diameter. A piece of permanent aluminum filter material made of woven aluminum strands, as used in air conditioning filters, measuring about 25 cm by 15 cm (10 in by 6 in) and 6 mm (0.25 ins) thick, was rolled tightly into a cylinder and inserted endwise into the pipe. The device was employed in a system of about 10 h.p. capacity with the sensor bulb fastened to the suction line immediately downstream of the device. Despite its relatively short length it still resulted in an increase of approximately 20% in the cooling capacity of the coil.

Combinations of these different devices can also be employed, as disclosed in more detail in my above identified prior application.

I claim:

1. Apparatus for the sensing of the temperature of refrigerant exiting from a refrigeration system evaporator coil outlet and for the control in accordance with the temperature sensed by a sensing means of a controllable evaporator valve feeding liquid refrigerant to the evaporator coil inlet, the sensing means comprising a fluid-containing elongated cylindrical bulb connected by a metal capillary tube to a charged diaphragm capsule in the valve, the apparatus comprising:

a turbulating and mixing device having an inlet and an outlet for refrigerant and having therein a refrigerant flow path having at least part of a wall thereof of heat conductive material for sensing the enclosure device interior temperature through the wall part;

the said wall part having formed in a portion thereof a radially outwardly opening groove into which the sensing means cylindrical bulb can be inserted and from which it can be removed, the groove being of transverse cross-section corresponding to that of the part of the cylindrical bulb in the groove whereby the wall of the part of the cylindrical bulb within the groove is in heat exchange contact with the wall part, thereby increasing the area of heat conductive contact of the sensing means cylindrical bulb with the groove wall;

and turbulence and mixing producing means in the flow path intercepting the entire refrigerant flow and creating turbulence and mixing of the refrigerant with changes in the direction of the entire refrigerant flow to ensure turbulence and mixing of all liquid and vapor refrigerant phases present and contact of only mixed phases with at least the groove wall part.

2. Apparatus as claimed in claim 1, wherein the said wall part has at least two circumferentially spaced grooves of different sizes, in each of which a respective sensing means cylindrical bulb can be disposed in heat exchange contact with the wall part, each groove corresponding in cross-section to the cross-section of the part of the respective sensing means cylindrical bulb when disposed within the groove to increase the area of heat conductive contact of the sensing mean cylindrical bulb with the respective groove wall part.

3. Apparatus as claimed in claim 1, wherein the surface of the part of the groove wall contacted by the sensing mean cylindrical bulb is provided thereon with a layer of heat conductive paste that is engaged by the sensing means cylindrical bulb to improve the heat conduction from the groove wall to the sensing means cylindrical bulb.

4. Apparatus as claimed in claim 1, wherein the turbulence and mixing producing means comprises first and second passage having a wall in common between them, the said common wall having therein a plurality of bores through which the refrigerant flows from the first passage to the second passage, the bores thereby producing an abrupt change in direction of the flow with impingement of the flow against a first surface of the second passage to produce the said turbulence and mixing of the flow in the second passage, another wall of the second passage providing the said first surface of the second passage and having the said radially outwardly opening groove formed therein.

5. Apparatus as claimed in claim 4, wherein the first passage is provided by a first tubular member, and the second passage is provided by a second tubular member surrounding the first tubular member to form an annular second passage between them, the said bores being provided in the wall of the first tubular member and directing the refrigerant flow against the inner surface of the wall of the second tubular member constituting the said another wall of the second passage.

6. Apparatus as claimed in claim 5, wherein one open end of the first tubular member constitutes an inlet to the first passage, and the other end of the member is closed to provide a transverse barrier for impingement of the refrigerant flow against the closed end and resultant turbulence in the first passage.

7. Apparatus as claimed in claim 5, wherein the first tubular member is provided with a transverse barrier at least approximately midway along its length dividing its interior into first and third passages, and against which the refrigerant flow impinges to produce resultant turbulence in the first passage;

a first set of said bores is provided in the wall of the first chamber directing the refrigerant flow into the second chamber against the inner wall of the second tubular member which constitutes the said another wall of the second passage;

and a second set of said bores is provided in the wall of the third chamber directing the refrigerant flow from the second chamber into the third chamber.

8. Apparatus as claimed in claim 4, wherein the first passage is filled with a body of porous turbulating and mixing medium through which the refrigerant must pass from the inlet to the plurality of bores.

9. Apparatus as claimed in claim 8, wherein the said porous turbulating and mixing medium is selected from metallic wool, metallic foam, metallic screen, plastic foam of porous ceramic foam.

10. Apparatus a claimed in claim 1, and including two turbulating and mixing devices connected in series with one another to increase the turbulence and mixing of the refrigerant and improve temperature sensing, at least the downstream device having the said wall part having a radially opening groove formed therein for receiving the sensing means cylindrical bulb.

11. Apparatus for the sensing of the temperature of refrigerant exiting from a refrigeration system evaporator coil outlet and for the control in accordance with the temperature sensed by a sensing means of a controllable evaporator valve feeding liquid refrigerant to the evaporator coil inlet, the sensing means comprising a fluid-containing elongated cylindrical bulb connected by a metal capillary tube to a charged diaphragm capsule in the valve, the apparatus comprising:

turbulating and mixing device having an inlet and an outlet for refrigerant and having therein a refrigerant flow path having at least part of wall thereof of heat conductive material for sensing the enclosure device interior temperature through the wall part;

the device comprising a first tubular member having a first tubular wall and having at least approximately midway along its interior a transverse barrier member dividing the interior into a first chamber connected to the inlet and a second chamber connected to the outlet and against which the refrigerant flow impinges to produce resultant turbulence in the first chamber;

a second tubular member having a second tubular wall surrounding the first tubular member to form an annular second chamber between the first and second tubular walls;

a first set of bores provided in the part of the first tubular wall of the first passage and directing the refrigerant flow into the second chamber against the inner surface of the second tubular wall, and;

a second set of bores provided in the part of the first tubular wall of the third chamber directing the refrigerant flow from the second chamber into the third chamber.

12. Apparatus as claimed in claim 11, wherein the transverse barrier member is retained in the first tubular member interior by radially inwardly extending parts of the first tubular member wall on opposite sides of the transverse barrier member.

13. Apparatus as claimed in claim 11, wherein the first tubular member is retained inside the second tubular member by radially inwardly extending parts of the second member wall which engage opposite ends of the first tubular member.

14. Apparatus for the sensing of the temperature of refrigerant exiting rom a refrigeration system evaporator coil outlet and for the control in accordance with the temperature sensed by a sensing means of a controllable evaporator valve feeding liquid refrigerant to the evaporator coil inlet, the sensing means comprising a fluid-containing elongated cylindrical bulb connected by a metal capillary tube to a charged diaphragm capsule in the valve, the apparatus comprising:

a length of pipe having an inlet and an outlet for refrigerant and having in its interior a refrigerant flow path having at least part of a wall thereof of heat conductive material for sensing the device interior flow path temperature through the wall part;

the said wall part having formed in a portion thereof a radially outwardly opening groove into which the sensing means cylindrical bulb can be inserted and from which it can be removed, the groove being of transverse cross-section corresponding to that of the part of the cylindrical bulb disposed in the groove whereby the wall of the part of the cylindrical bulb within the groove is in heat exchange contact with the wall part, thereby increasing the area of heat conductive contact of the sensing means cylindrical bulb with the groove wall part.

15. Apparatus as claimed in claim 14, wherein the said wall part has at least two circumferentially spaced grooves of different sizes, in each of which a respective sensing means cylindrical bulb can be disposed in heat exchange contact with the wall part, each groove corresponding in cross-section to the cross-section of the part of the respective sensing mean cylindrical bulb when within the groove to increase the area of heat conductive contact of the sensing means cylindrical bulb with the respective groove wall part.

16. Apparatus as claimed in claim 14, wherein the surface of the part of the groove wall contacted by the sensing means cylindrical bulb is provided thereon with a layer of heat conductive paste that is engaged by the sensing means cylindrical bulb to improve the heat conduction from the groove wall to the sensing means cylindrical bulb.

17. Apparatus as claimed in claim 14, wherein the pipe interior is filled with a body of porous turbulating and mixing medium through which the refrigerant must pass from the inlet to the outlet.

18. Apparatus as claimed in claim 17, wherein the said porous turbulating and mixing medium is selected from metallic wool, metallic foam, metallic screen, plastic foam or porous ceramic foam.

* * * * *